United States Patent [19]

Novy

[11] 3,953,928

[45] May 4, 1976

[54] COOLING OF HOT PARTICULATE MATERIAL PARTICULARLY CALCINED PETROLEUM COKE

[75] Inventor: Anton R. Novy, Johnson City, Tenn.

[73] Assignee: Great Lakes Carbon Corporation, New York, N.Y.

[22] Filed: Apr. 25, 1975

[21] Appl. No.: 571,850

[52] U.S. Cl. ..... 34/13; 34/20; 201/3; 201/13; 202/228

[51] Int. Cl.[2] ..... F26B 7/00

[58] Field of Search ..... 34/13, 20; 432/77; 201/3, 13; 202/228

[56] References Cited

UNITED STATES PATENTS

| | | | |
|---|---|---|---|
| 2,581,409 | 1/1952 | Harlow | 34/20 X |
| 3,774,315 | 11/1973 | Schmalfeld et al. | 34/13 |
| 3,800,428 | 4/1974 | Ahland et al. | 34/20 |
| 3,892,044 | 7/1975 | Kayatz | 34/20 |

*Primary Examiner*—John J. Camby
*Attorney, Agent, or Firm*—Carl F. Peters

[57] ABSTRACT

A method of cooling a hot particulate material, such as calcined petroleum coke, is described.

The stream of hot particulate material is split as it leaves the device or calciner in which it has been heated. A major portion of it, such as about 80–90%, is dropped directly into a tank of hot water. This material is then separated from the hot water while simultaneously being transferred to a cooling device (such as a rotary cooler) by a suitable conveyor system. The minor portion of hot material is transferred directly from the calciner to the cooling device. In the cooling device, the residual heat content in this hot, minor portion of particulate material is used to drive off the remaining water or moisture contained in the quenched major portion of material.

11 Claims, 1 Drawing Figure

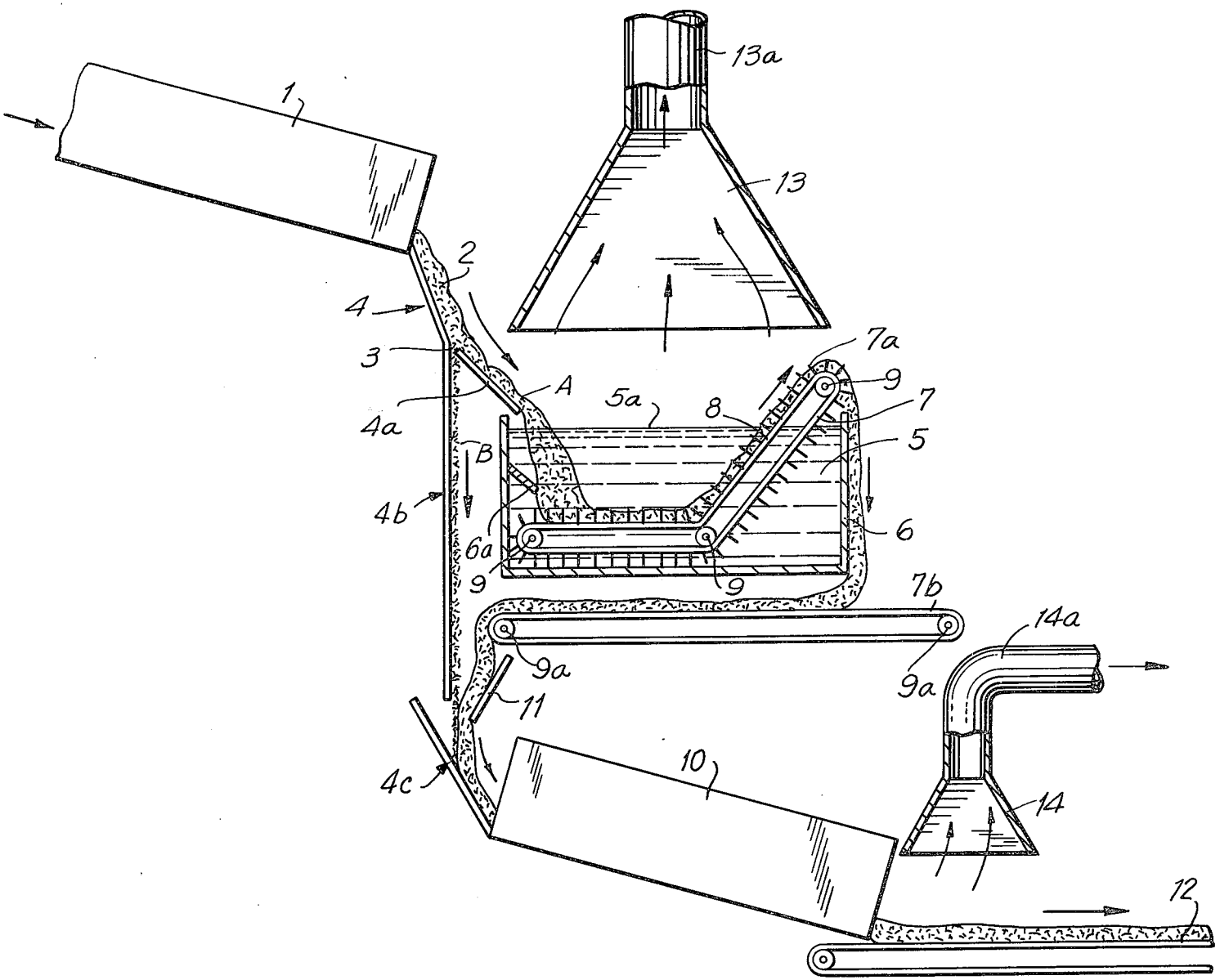
1
2
3
4
4a
4b
4c
5
5a
6
6a
7
7a
7b
8
9
9a
10
11
12
13
13a
14
14a
A
B

COOLING OF HOT PARTICULATE MATERIAL PARTICULARLY CALCINED PETROLEUM COKE

BACKGROUND OF THE INVENTION

1. Field of the Invention

This invention relates to the controlled cooling of a hot particulate material and particularly a hot particulate carbon type material which must be cooled in order that it might be further handled and used. The invention is even more particularly concerned with the cooling of calcined "delayed" petroleum coke, i.e., petroleum coke which has been produced in a delayed coker before being calcined.

2. Description of the Prior Art

The invention will be described by specific reference to the processing of "delayed" petroleum coke, it being understood that its teachings are applicable to the processing of other hot particulate materials.

In the usual way of producing "delayed" calcined petroleum coke, the "raw" petroleum coke from the delayed coker is processed through a slightly inclined rotary kiln (typical dimensions of which might be 10 feet in diameter and 180 feet long) wherein it is heated to an elevated temperature such as 2000°–2600° F, which temperature causes a change in the volatile matter (VM) content of the coke from an initial VM typically between 8 and 20% to a final VM content of less than 1%.

Typically, the raw petroleum coke is removed from the delayed coker by the use of high pressure water jets. The action of these water jets generates some coke"fines." Also, in its passage through the long rotary kiln the coke is abraded some more due not only to the distance it travels and the rotation of the kiln, but due also to the typical use of "lifters" of modest height within the kiln which subject the coke particles in some measure to lifting-falling action during their passage through the kiln while they are being heated. This abrasion of the coke occurring in the kiln also generates some coke "fines" and also coke "dust."

After being heated in the kiln, the calcined coke is then cooled. In a typical commercial practice, this is done by transferring the coke directly into a long rotary cooler wherein it is exposed to water spray nozzles and air and wherein its temperature is reduced from its calcination temperature to a much lower exit temperature, at which it can be shipped or stored, such as 200° F or lower. (A maximum temperature limitation of 130°–150° F on coke loaded into the holds of ships is a common requirement.) Such a cooling method has always given rise to problems in controlling the temperature of the coke and the residual water content of the product, as well as to pollution problems. These latter problems of pollution alone may require an expenditure of $200,000 to $300,000 per individual calciner-cooler commercial installation to overcome same.

In cooling the calcined coke to the desired degree in the rotary cooler, the calcined coke is also typically subjected to mechanical action similar to that which takes place in the rotary kiln. This also causes some size degradation of the particles as does the action of the water from the spray nozzles.

Thus the generation of "fines" and "dust" of relatively substantial magnitude has been, and is in current practices a "necessary evil" in order to make the desired calcined coke product, as it frequently is also in the production of particulate materials other than calcined coke.

As used herein, "fines" are defined as particles smaller than generally desired by the user or purchaser of the coke or other particulate product, and "dust" refers to particles so small that their presence can, for example, be ascertained simply by dropping a handful of the coke or other type particulate product upon a surface from a height of about two feet and observing a "cloud" of dust or particles separating from the general mass of the rest of the material landing upon the surface.

Such "fines" typically are of reduced economic value as compared to the rest of the calcined coke or other particulate type product; the "dust" not only has this disadvantage but also causes an air pollution problem, not only at the site of the calcined coke (or other type particulate material) manufacture but also at any final use location or shipment transfer point of the particulate product.

Summary of the Invention

It is an object of the present invention to efficiently cool calcined petroleum coke and other hot particulate type products. It is another object of the present invention to utilize equipment presently typically used by industry to produce calcined petroleum coke and other particulate type products but also to substantially reduce the "fines" and/or the "dust" problems generated or involved in the handling of such products. It is another object to accomplish the foregoing in a highly efficient manner and in a manner involving a minimum of additional capital expense for those coke calcining or particulate material producing installations employing cylindrical rotary coolers.

These and other objects of the present invention are achieved by unique intermediate processing steps carried out between the calcining and cooling operations previously referred to and which are standard in the art.

For simplification, and also with regard to the invention in its preferred embodiment, the method hereinafter mostly described is with reference to calcined "delayed" petroleum coke as the "particulate material" being cooled. It should be appreciated, however, that the invention is not so limited.

DESCRIPTION OF THE DRAWING

The process is illustrated schematically in the attached drawing. Rotary kiln 1 is used to heat and calcine the raw "delayed" petroleum coke to a temperature such as 2400° F. During this step the raw coke, which typically has a volatile matter (VM) content of 8–20%, is substantially devolatilized.

Instead of being introduced directly into rotary cooler 10, as is a standard practice of the prior art, the coke is subjected to unique and advantageous intermediate processing steps which are now described.

Upon leaving the kiln 1, the hot coke 2 is divided into separate major and minor portions or streams A and B, respectively. The splitting or division takes place in area 3 and may be accomplished in any suitable manner or through the use of any suitable splitting device capable of dividing the initial stream 2 on an approximate volumetric and/or weight basis. The division is effected in such a manner that the quantity of material in the major portion A will typically be at least 70% of the total coke to be cooled. Numbers or symbols **4, 4*a***, 4*b*, and 4*c* designate refractory brick lined chutes capable of withstanding the particle temperatures encountered.

Stream A is immersed or dropped directly into water 5 in quenching tank 6. Water 5 is typically at or near its boiling point or soon brought to same because of the high temperature of the particles immersed in same. The level 5*a* of the water in the tank is maintained substantially constant by replacement and/or recycling. The coke drops upon a constantly moving dewatering conveyor system 7, such as a porous belt with lifters 7*a*. The particulate material is thus separated from the water at 8 as it leaves the quenching tank. Revolving rollers 9, actuated from outside the tank 6, serve to impart the desired continuous movement to the dewatering conveyor system 7. Diverter plate 6*a* in tank 6, and similar buffer means along the longitudinal walls of tank 6 serve to direct and keep all of the particulate material being cooled on the conveyor system 7.

The major portion A of particulate material, which is thus cooled to about 212° F or slightly lower, and which has simultaneously been conveyed while being cooled, is then conveyed by conveyor belt system 7*b* and actuated rollers 9*a* into cooler 10 via chute 11, which may also be refractory brick lined, where it is merged and blended with the minor portion B of non-quenched particulate material while the two materials gradually descend through rotary cooler 10. The blended materials are in contact with each other for a sufficient length of time that substantially all of the remaining moisture in the quenched material is caused to be vaporized by the heat received from the non-quenched material and the temperature of the non-quenched material is substantially lowered so that the average temperature of the merged materials is reduced to a temperature at which it can be shipped or stored, such as the aforesaid maximum of about 130°–150° F when the blend leaves the rotary cooler. The combined cooled materials from streams A and B are then conveyed away from cooler 10 by conveyor 12 to a stockpile or into a silo or a loading vessel or railcar for shipment.

Steam hood 13 and steam vent 13*a* collect the steam evolving from quench tank 6. Hood 14 and vent 14*a* are employed to collect dust and steam from cooler 10 and convey them to where desired, such as to a settling chamber (not shown).

To indicate the thermal balance or relationship which takes place in the cooling technique of the present invention, the following Example is set forth.

EXAMPLE

If the coke leaves the quench tank 6 at 212° F and contains 12% water (which is a representative figure), the 0.12 pounds of water per pound of quenched wet product requires 0.12 × 1080 BTU/lb. or 130 BTU for vaporization. To supply this heat, taking into consideration also its further temperature reduction from 212° F to 150° F as it leaves cooler 10, a material balance of about 12% hot coke B (at an assumed temperature of 2400° F) and 88% quenched coke A would be employed. Fifteen of the 130 BTUs would come from the quenched coke and the other 115 BTUs would come from the hot coke, based on the following computations:

The 15 BTUs from the quenched coke is calculated by multiplying its temperature change (212°–150°) times it specific heat in BTU per lb. per degree Fahrenheit, which is about 0.25 in this temperature range, to arrive at the product of approximately 15 BTUs.

The 115 BTUs from the hot coke is calculated by multiplying its temperature change (2400°–150°) times its specific heat, which is about 0.45 in this temperature range, to arrive a the product of approximately 115 BTUs.

It will be obvious from the foregoing that different material balances will sometimes be employed and/or desirable depending upon such factors as heat losses, the initial temperature of the hot coke before it is mixed with the quenched coke, the percentage of moisture retained in the quenched product, and the final product temperature desired or required. For desirable cooling rates and preferred processing conditions, the minor hot portion of the calcined carbonaceous material to be cooled will generally be at least about 10% and no higher than about 30%. This ratio of 30:70 of minor portion to major portion is calculated on the basis of theoretical heat contents and no heat losses, and a calcining temperature of 2400° F. As indicated, the ratio will vary depending on such factors as reduced calcining temperature, heat losses, etc. Such factors will tend to increase the quantity of coke sent directly to the cooler.

The process of cooling hot particles described herein significantly reduces the dust control or pollution problem of typical prior and present commercial practices employing rotary coolers.

In such prior art cooling method(s), the hot coke is contacted by streams of water which burst into steam and create a highly turbulent environment. The fines from the coke are raised into the gas stream and swept from the cooler. The velocities in the cooler are extremely high due to the volume of steam generated in the cooler which helps carry any airborne particles from the cooler. Also, because of the high humidity in the cooler gases, final drying of the coke is difficult.

In the present process, the coke is dropped into the water tank 6 and the dust tends to be trapped in the water system. The steam generated can be and is vented directly to the atmosphere without cleaning. The gases drawn through the cooler are relatively low in moisture content and thus the coke also becomes so more quickly and more efficiently. Also, it is no longer necessary to use lifters in the cooler to bring the gases and coke more intimately into contact to cool the coke, thereby avoiding the fracturing of the coke and generation of more fines due to presence of the lifters.

Also, because most of the cooling required takes place in tank 6 in the process of this invention, the capacity and/or rate of throughput of product through cooler 10 is greatly increased. The process thus provides better control of the temperature and moisture content of the product and thus also avoids problems which have frequently arisen under past commercial practice, i.e., throughput of portions of the coke product whose temperature and/or moisture content are still undesirably high when the coke is loaded into the hold of a ship.

I claim:

1. A method of cooling a calcined particulate material from its approximate temperature of calcination to a lower temperature at which it can be shipped or stored which comprises:

a. dividing the particulate material into separate major and minor portions;

b. immersing the major portion in a quenching tank of water to cool it;

c. separating the cooled particulate material from the water; and d. merging the cooled major portion of quenched particulate material with the minor portion of substantially hotter non-quenched material in suitable proportions and for sufficient length of time that substantially all of the remaining moisture in the quenched material is caused to be vaporized by the heat received from the non-quenched material and the temperature of the non-quenched material is substantially lowered so that the average temperature of the merged materials is reduced.

2. A method according to claim 1 wherein the material being cooled is a carbonaceous material.

3. A method according to claim 1 wherein the material is cooled to a temperature below 200° F.

4. A method according to claim 1 wherein the material is cooled to a temperature no higher than about 150° F.

5. A method of cooling a calcined particulate material from its approximate temperature of calcination to a temperature no higher than about 200° F which comprises:

a. splitting the calcined particulate material as it leaves the calciner into separate major and minor portions;

b. cooling the major portion by dropping it directly into a quenching tank of water wherein it is immersed and cooled;

c. separating the cooled major portion of calcined particulate material from the water while simultaneously conveying it to a rotary cooler; and d. merging the cooled major portion of quenched calcined particulate material with the minor portion of substantially hotter non-quenched material in suitable proportions and for sufficient length of time in the rotary cooler that substantially all of the remaining moisture in the quenched material is caused to be vaporized by the heat received from the non-quenched material and the temperature of the non-quenched material is substantially lowered, so that the average temperature of the merged materials is reduced to the aforesaid maximum of about 200° F when it leaves the rotary cooler.

6. A method according to claim 5 wherein the material being cooled in a carbonaceous material.

7. A method according to claim 5 wherein the material is cooled to a temperature no higher than about 150° F.

8. A method according to claim 5 wherein the material is cooled to a temperature no higher than about 130° F.

9. A method of cooling a calcined delayed petroleum coke carbonaceous material from its approximate temperature of calcination of between about 2000° F and about 2600° F to a temperature no higher than about 200° F which comprises:

a. splitting the calcined coke carbonaceous material as it leaves the calciner into separate major and minor portions, the quantity of material in the major portion being at least about 70% of the total coke material being cooled;

b. cooling the major portion by dropping it directly into a quenching tank of water wherein it is immersed and cooled;

c. separating the cooled major portion of calcined carbonaceous material from the water while simultaneously conveying it to a rotary cooler; and d. merging the cooled major portion of quenched calcined carbonaceous material with the minor portion of substantially hotter non-quenched material for sufficient length of time in the rotary cooler that substantially all of the remaining moisture in the quenched material is caused to be vaporized by the heat received from the non-quenched material and the temperature of the non-quenched material is substantially lowered, so that the average temperature of the merged materials is reduced to the aforesaid maximum of about 200° F when it leaves the rotary cooler.

10. A method according to claim 9 wherein the material is cooled to a temperature no higher than about 150° F.

11. A method according to claim 9 wherein the material is cooled to a temperature no higher than about 130° F.

* * * * *